US009441789B2

(12) United States Patent
Shubbar et al.

(10) Patent No.: US 9,441,789 B2
(45) Date of Patent: Sep. 13, 2016

(54) PRESSURE TANK WITH PLUG AND WELDING CONNECTION FOR THE CONNECTOR

(76) Inventors: Amir R. Shubbar, Aschaffenburg (DE); Mahdi Shubbar, Aschaffenburg (DE)

( * ) Notice: Subject to any disclaimer, the term of this patent is extended or adjusted under 35 U.S.C. 154(b) by 0 days.

(21) Appl. No.: 14/241,945

(22) PCT Filed: Aug. 16, 2012

(86) PCT No.: PCT/DE2012/000824

§ 371 (c)(1),
(2), (4) Date: Apr. 25, 2014

(87) PCT Pub. No.: WO2013/029586

PCT Pub. Date: Mar. 7, 2013

(65) Prior Publication Data

US 2014/0224811 A1 Aug. 14, 2014

(30) Foreign Application Priority Data

Aug. 30, 2011 (DE) ..... 10 2011 111 406

(51) Int. Cl.
*F17C 1/06* (2006.01)
*E03B 1/00* (2006.01)
(Continued)

(52) U.S. Cl.
CPC ..... *F17C 13/04* (2013.01); *F17C 1/16* (2013.01); *F17C 2201/0109* (2013.01); *F17C 2201/032* (2013.01); *F17C 2201/056* (2013.01); *F17C 2203/0604* (2013.01); *F17C 2203/066* (2013.01); *F17C 2203/0619* (2013.01);
(Continued)

(58) Field of Classification Search
CPC ..... F17C 2205/0305; F17C 1/16; F17C 2209/221; F17C 2209/227; F17C 13/06; F17C 2221/035; F17C 2223/0153; Y02E 60/321; Y10T 137/7062; Y10T 403/366
USPC ..... 220/589; 137/382
See application file for complete search history.

(56) References Cited

U.S. PATENT DOCUMENTS 2,919,048 A * 12/1959 Harvey ..... 220/327
5,839,600 A * 11/1998 Moreira ..... F17C 1/16 220/560.04
(Continued)

FOREIGN PATENT DOCUMENTS

| | | | |
|---|---|---|---|
| DE | 10 2008 052 133 | A1 | 4/2010 |
| EP | 0 874 187 | A1 | 10/1998 |
| WO | 2008/110130 | A1 | 9/2008 |
| WO | 2010/053146 | A1 | 5/2010 |

OTHER PUBLICATIONS

International Search Report for PCT Application No. PCT/DE2012/000824, dated Jan. 28, 2013, 6 pages.

*Primary Examiner* — Shawn M Braden
(74) *Attorney, Agent, or Firm* — Westman, Champlin & Koehler, P.A.

(57) ABSTRACT

Pressure tank, comprising a hollow body of thermoplastic material with at least one outlet, into which one connector each is inserted, which has at least one aperture each to the interior of the hollow body, with a sealing flange which is integrally formed around the outlet to the connector. This sealing flange is visible to the outside and is welded and/or bonded to the hollow body, on which at least one torque coupling is integrally formed, whose cross-section is polygonal or non-circular and which is inserted in a complementary coupling socket in the hollow body, running around the outlet.

16 Claims, 1 Drawing Sheet

(51) Int. Cl.
*F17C 13/04* (2006.01)
*F17C 1/16* (2006.01)

(52) U.S. Cl.
CPC ..... *F17C 2203/0663* (2013.01); *F17C 2205/0305* (2013.01); *F17C 2205/0373* (2013.01); *F17C 2209/2118* (2013.01); *F17C 2209/2127* (2013.01); *F17C 2221/033* (2013.01); *F17C 2221/035* (2013.01); *F17C 2223/0123* (2013.01); *F17C 2223/0153* (2013.01); *F17C 2223/033* (2013.01); *F17C 2223/035* (2013.01); *F17C 2223/036* (2013.01); *F17C 2260/036* (2013.01); *F17C 2270/0745* (2013.01)

(56) References Cited

U.S. PATENT DOCUMENTS

| | | | | |
|---|---|---|---|---|
| 7,017,771 | B1 | 3/2006 | Kothera et al. | |
| 7,287,663 | B2 * | 10/2007 | Vandal et al. | 220/586 |
| 2009/0309000 | A1 * | 12/2009 | Guckes | 248/309.1 |
| 2010/0018972 | A1 | 1/2010 | Kao | |
| 2011/0101002 | A1 | 5/2011 | Strack | |
| 2011/0140412 | A1 * | 6/2011 | Manser et al. | 285/192 |
| 2011/0210128 | A1 * | 9/2011 | Strack et al. | 220/592 |
| 2011/0303681 | A1 * | 12/2011 | Newhouse et al. | 220/581 |
| 2012/0205337 | A1 * | 8/2012 | Holbach | F17C 13/06 215/40 |

* cited by examiner

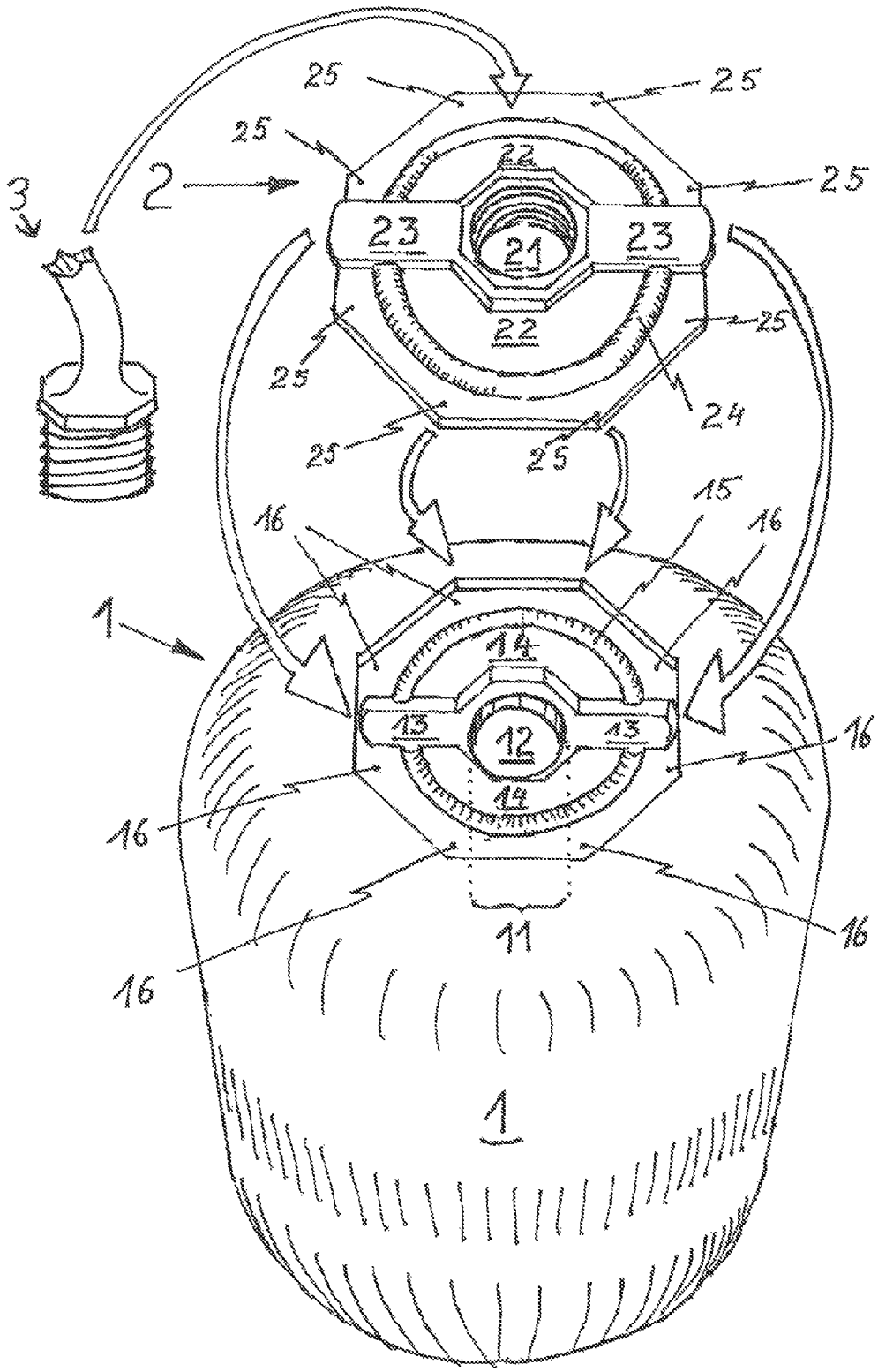
3
2
25
25
25
25
22
23
21
23
22
25
25
24
25
25
15
16
16
1
14
13
12
13
14
16
16
16
16
11
1

PRESSURE TANK WITH PLUG AND WELDING CONNECTION FOR THE CONNECTOR

This Application is a Section 371 National Stage Application of International Application No. PCT/DE2012/000824, filed 16 Aug. 2012 and published as WO 2013/029586 A1 on 7 Mar. 2013, in German, the contents of which are hereby incorporated by reference in their entirety.

The invention relates to a pressure tank, comprising a hollow body of thermoplastic material with at least one outlet, into which one connector each is inserted, which has at least one aperture each to the interior of the hollow body.

In the prior art tanks for holding gases or liquids are known, which are under high pressure, such as liquefied petroleum gas (LPG) or compressed natural gas (CNG). These tanks are manufactured inter alia of thermoplastic material in a blow moulding or injection moulding process. In order to increase the compressive strength, these tanks are covered in a second step with an outer layer of resilient fibers, which are generally embedded in a resin, which bonds the fibers to each other and fixes them to the inner plastic layer.

Regardless of the embodiment, such a tank has to be provided in any case with at least one connector, to which a valve, a hose or a tube is coupled in order to fill or to empty the tank. These elements have in most cases as an interface a metal tube socket with a thread or a bayonet, which must be connected pressure-resistant and tightly with a complementary shaped counterpart in the connector of the tank.

In the prior art plastics with sufficient tensile strength are known for the connectors, which can be produced also as a hollow body with sufficient wall thickness and suitable threads or bayonet guides.

As the wall thickness and the accuracy requirements of the connectors differ considerably from the wall thickness and the tolerances of the pressure tank, it is in practice neither reasonable nor economically, to manufacture the connectors and the tanks all of a piece.

Rather, it is common to provide a hollow plastic container after its completion in a further step with a separately produced and in most cases multi-part connector. For example, patent application U.S. 2011/010/1002 describes a plastic tank with two outlets. Onto these outlets from the outside and from the inside each an approximately cylindrical connector is placed, which is widened at one end with a collar-like flange. These two parts are screwed together with a thread and thus pressed together, so that they lie plainly from the inside and from the outside on the area around the outlet of the tank. By corresponding pressure and by additionally inserted sealing rings in the tank or the flange, the required pressure strength is obtained.

A significant disadvantage of this and other similar approaches is that the connectors are configured rotationally symmetrical. If a screw coupling has to be made for connection with a hose, a tube or a valve, the connector has to transfer a torque to the tank. With rotationally symmetrical connectors, however, only the value of the tightening torque can be achieved, resulting from the pressing force of the two flanges to the tank and the coefficient of static friction of the two surfaces pressing on each other.

Since the surface of the plastic tanks is generally even and smooth, only a limited torque peak value is the result. If this is exceeded, it becomes difficult to establish a sufficiently tight connection. Additionally there is the risk that due to the rotating of the connector against the tank this connection is leaking quickly and the fluid, which is actually to be discharged, is continuously leaking and that with tendency to rise.

On this background, the present invention has tackled the task to develop for composite pressure tanks a connector, which transfers also peak values of a torque occurring during tightening of a screw or a bayonet, safely and permanently to the hollow body of plastic.

As a solution, the invention teaches that a sealing flange is integrally formed around the aperture to the connector. This sealing flange is visible to the outside and is welded and/or bonded to the hollow body and at least one torque coupling is integrally formed to it, whose cross-section is polygonal or non-circular and which is inserted into a complementary coupling socket in the hollow body, which is running around the outlet.

It is also an essential idea of the invention to separate the function of the sealing between the connector and the hollow body from the function of the torque transmission from the connector to the hollow body. In contrast to the prior art, in which these two functions are combined in one element, the present invention provides clearly separated areas of the connector:

The first, sealing area is the "sealing flange" The second, the torque transmitting area is the "torque coupling".

The sealing flange is visible to the outside when mounted. In the simplest case it has the shape of a disc, which is flange-mounted on the central body of the connector around the outlet. If the front edge of this disc is round, the disc does not have a torque coupling and serves only as sealing. The area of the flange facing the hollow body can be bonded to the hollow body.

Additionally or alternatively, the marginal area of the sealing flange can be welded to the hollow body, i.e. both the hollow body in the contact area of the sealing flange and the sealing flange itself in its marginal area are liquefied at the contact areas, by heating these areas beyond the melting temperature of the material and then pressing both parts on each other so that the liquids are mixed together. When the heating is completely revolving and uniformly, the connection between the sealing flange and the hollow body is sealed during cooling and solidification of the liquid.

As mentioned before, it is the essential idea of the invention that the connector comprises at least one further, the torque transmitting area, namely the "torque coupling". Such a torque coupling can either be formed on the side of the sealing flange which is facing the interior of the hollow body and/or on the front side of the sealing flange.

In both embodiments its function is similar to a wrench, which is placed on the head of a screw to transfer a torque. In a similar manner, the cross section of the torque coupling and the complementary coupling socket is formed:

In the most general case, a torque is transmitted by each non-circular cross-section, by pressing of all different from a circular line shaped areas of the outside area of the torque coupling to the complementary area of the coupling socket.

For the cross section simply to construct variants are polygons, i.e. polygons that consist of interconnected lines. The simplest polygon is a triangle. It has in principle the largest extension in the radial direction with respect to the central axis of the torque coupling. Applicable are of course also all other polygons, such as a rectangle, a hexagon (hexagon), an octagon (octagon), a nonagon (Neuneck), a decagon (decagon), a dodecagon (dodecagon) or another quantity of areas.

In the most general case, this polygon has a random shape. Since in practice, however, the connector usually has only one single circular outlet, it makes sense to choose a regular polygon, which surrounds the circular outlet with a regularly repeated variation of the wall thickness to the outlet. That is, all lines have the same lengths and form with each proximate line the same angle. With an increasing number of corners such a regular polygon approaches more and more the circle. Thus also the effective ratio of the area for transmitting the torque decreases in the longitudinal section. This effect is illustrated best by the fact that in the cross-section a circle is drawn inside the polygon, that touches all edges tangentially. A second circle is defined through the edges of the polygon, which is then concentric to the inner circle. The distance of the two circles from each other limits the area ratios that are effective for the torque transmission. With a regular triangle the area ratios are the largest, therefor there are however only three of these areas. With a regular dodecagon for example, these areas are significantly smaller, but are also present twelve times.

Typically for each polygon is that during the transmission of a torque it is loaded the most heavily in the area of its edges. This effect will be particularly visible when there is a small play between the coupling torque and the torque socket. Then the two parts each touch at the first moment only punctiformly. Only by the elasticity of the material the dot becomes an area with increasing force.

This limitation of all polygonal profiles, that in the area of the corners the pressure rises abruptly, can be avoided by the fact, that the outline is a waved line. Then the force load across the outer areas of the torque coupling and the coupling socket doesn't change abruptly but steadily.

As an alternative to polygonal cross-sections the outline of the torque coupling and the coupling socket can also be a star or another jagged line. Compared to a polygon, thus the area is increased, which transmits the force from one element to the other.

In a very simple illustrative embodiment of the torque coupling, it is integrally formed to the front edge of the sealing flange. When assuming theoretically a circular disc as sealing flange, the area of this disc is extended by the "corners" of a polygon. Of course a corresponding counterpart to these "corners" has to be created in the hollow body. In this variant, the diameter of the torque coupling is larger than the sealing area of the connector.

When the area of the sealing flange merges into the area of the torque coupling, there is no precisely defined border between the two areas visible at first glance.

In this embodiment, the area of the sealing flange contributes with its bonding of course also to the transmission of torque. If this area, however, starts to deform already slightly under the load of a torque, which is too high for it, then further torque is transmitted above the outside margin of this area onto the so-called "second torque coupling" and from there to the "second coupling socket". In this way, the connection between the sealing flange and the slot is protected against overload.

The areas for sealing and for transmission of the torque are to be distinguished very clearly in another embodiment of the torque coupling. In this variant, the torque coupling is integrally formed on the side of the sealing flange, which is facing to the inside area of the sealing flange—that is closer to the center of the tank. Here the torque coupling—e.g. as a polygonal profile—is attached to the inside area of the sealing flange and is therefore to be seen at first glance as pure torque coupling.

In a further stage of the torque coupling at the inside of the sealing flange, it is proposed for the outline of the cross section of the torque coupling and of the coupling socket, that to a core area at least one strip-shaped area is integrally formed, facing outwards approximately radially. The strip-shaped area is then directing from the core area approximately similar as the blades from the hub in a propeller.

The two embodiments of the torque coupling described above can be used either alone or also in a combination. In the last-mentioned variant the connector of the invention has even two torque couplings: one on the front face of the sealing flange and the other on the area facing towards the tank.

In a more refined embodiment, a further, annular slot is placed beneath the sealing flange in the complementary slot, in which a seal such as an O-ring is inserted. In the case that the welding or bonding of the sealing flange is not perfectly sealed, the O-ring seal performs this function.

In another variant, elongate welding ribs are integrally formed to the sealing flange and/or the torque coupling. In a first variant the material of these welding ribs projecting the proximate areas will liquefy when welded and will spread on the proximate areas of the sealing flange and the coupling socket and/or the slot on the surface of the hollow body and thus ensure a tight connection.

This effect can thereby be amplified that the welding ribs rest on same extending second welding ribs, which are also melted during the welding process, so that even more liquid material is available.

Alternatively, the welding ribs join into complementary shaped weld notches in the slot or in the coupling socket. When welding the sealing flange, the liquefied material of the welding ribs flows into the weld notches and liquefies there the top layer.

In all three variants, the profile of welding ribs and weld notches can be curved or angular. In their course ribs and notches can be continuously straight or waved. However a dotted or dashed course is also possible and reasonable.

In the simplest case, the sealing flange lies on the surface of the hollow body around the outlet. Alternatively, for an even better connection of the sealing flange with the hollow body, the sealing flange can be inserted into a complementary slot of the hollow body, which surrounds the coupling socket.

The hollow body of a pressure tank of the present invention is in practice usually made of a thermoplastic, which receives its shape by blow moulding or by injection moulding in a corresponding counterpart. Advantages of this method are the relatively short processing time and comparatively low processing costs in the production of each single exemplar. A limitation is however, that such a hollow body can only withstand a very limited pressure. Therefore, the compressive strength is increased by applying fibres such as glass fibres or carbon fibres or aramid fibres or dyneema fibres. These fibres are laid in rings or in waved lines around the hollow body and are bonded with resins to each other and on the hollow body. These resins may then be crosslinked thermally or by radiation with UV light and thus cured.

In the simplest case, the connector contains for the connection of the therewith linked valve or hose or tube an internal thread, a bayonet or the counterpart of another coupling. For very filigree couplings or more stringent demands, a further coupling piece for example of metal, can be inserted or embedded in the outlet, which fits exactly to the connecting profiles. So that this additional profile itself is not rotating towards the connector during a torque transmission, it meaningfully has on its outside area a polygonal or other non-circular profile.

If this coupling piece is embedded in the connector, thus an exactly complementary counterpart is generated. Between the connector and the coupling the torque is then transmitted in the same way as between the connector and the hollow body.

Below further details and features of the invention shall be explained more detailed by means of an example. This shall however not limit, but only explain the invention. It shows a schematic illustration:

FIG. 1. Hollow body with connector before mounting.

FIG. 1 shows a pressure tank according to the invention prior to the mounting of the connector 2 to the hollow body 1. The hollow body 1 is here illustrated in vanishing point perspective by "angle from above." It is to see that in this embodiment it comprises a cylinder which ends hemispherically on its front sides.

In the front side of the hollow body 1, the outlet 11 is visible through which a view to the interior 12 of the hollow body is released.

The embodiment of a pressure tank of the invention shown here, comprises a connector 2, which transmits a torque from connector 2 to the hollow body 1 through the two—different from each other—torque couplings 23 and 25.

The first torque coupling 23 comprises a central octagonal area and on two opposite edges integrally formed strips, which is designed complementary to the first coupling socket 13 in the hollow body 1. This extends around the outlet 11. In the shown embodiment, it comprises an octagon, to which on two opposite edges strip-shaped extensions are formed integrally, which extend radially to the outlet 11. The first coupling socket 13 is the level which is countersunk the most into the surface layer in the area of the outlet 11.

The second torque coupling 25 is in the illustrated embodiment also a polygon, which is designed here as an octagon, that continues without further outlet directly from the sealing flange 22.

In FIG. 1 the comparison between the outer shape of the connector 2 and the largest outline of the slots in the hollow body 1 quickly make clear, where the second coupling sockets 16 are placed. They are in the illustrated embodiment a direct continuation of the slot 14 and visible as "corners" on the edge of this slot.

For torque transmission from the connector 2 to the hollow body 1 serves in the embodiment shown in FIG. 1 not only the first torque coupling 23 which is inserted into the complementarily shaped first coupling socket 13 in the hollow body 1, but as an additional reinforcement also the octagonal second torque coupling 25 on the sealing flange 22 and the complementary second coupling socket on the edge of the slot 14.

By four double arrows it is illustrated how the connector 2 has to be rotated and lowered so that it can be inserted into the slot 14 and the two coupling sockets 13 and 16.

In FIG. 1, it is understandable that after inserting the connector 2, the first torque coupling is no longer visible to the outside, as it is covered by the—larger—sealing flange 22. Visible is then only the second torque coupling 25, which then covers the complementary second coupling sockets 16.

FIG. 1 illustrates that the slot 14 provides a relatively large area compared to the size of the outlet 21 in the connector 2. Therefore an additional sealing effect can be achieved by bonding the relatively large sealing flange 22 with the slot 14.

As an additional variant is in the illustrated embodiment a further e.g. metallic coupling piece 3 can be inserted in the middle of the connector 2 around the outlet 21. It offers a thread on its internal side, with which a valve, a tube or a hose can be connected. Alternatively the guides of a bayonet or other elements can be formed integrally.

In FIG. 1 is shown as a further embodiment, that elongate bead welding ribs 24 are integrally formed to the sealing flange 22, here in the form of two circular arc segments that engage into complementarily shaped weld notches 15 in the slot 14. When welding the sealing flange 22, the liquefied material of the welding ribs 24 flows into the weld notches 15 and liquefies there the top layer, so that the welding rib 24 and the weld notches 15 are connecting with each other tightly.

LIST OF REFERENCE NUMERALS

1 hollow body
11 outlet in the hollow body 1
12 interior of the hollow body 1
13 first coupling socket in the hollow body 1 for first torque coupling 23
14 slot on the surface of the hollow body 1, complementary to sealing flange 22
15 weld notch in slot 14 or in coupling socket 13
16 second coupling socket in hollow body 1 for second torque coupling 25
2 connector, inserted into outlet 11
21 aperture in connector 2 to the interior 12
22 sealing flange on connector 2, welded or bonded to hollow body 1
23 first torque coupling on connector 2, inserted in first coupling socket 13
24 welding ribs on sealing flange 22 and/or torque coupling 23
25 second torque coupling on connector 2, inserted in the second coupling socket 16 in the hollow body 1.

The invention claimed is:

1. A pressure tank comprising:

a hollow body of thermoplastic material having at least one opening; and into each of said at least one opening there is inserted a connector, each of said connectors having at least one passage to an interior space of the hollow body and a sealing flange surrounding the passage, the sealing flange including a portion that overlays and is welded and/or adhesively bonded to a portion of the hollow body, said portion of the sealing flange being visible from an exterior side of the hollow body, and at least one torque coupling, each torque coupling integrally formed on said sealing flange and having a polygonal shape, wherein each torque coupling is plugged into a complementary coupling socket in the hollow body that surrounds said opening.

2. The pressure tank according to claim 1, wherein the at least one torque coupling of each connector includes a first torque coupling emerging from a side of the sealing flange that faces the interior space, the first torque coupling plugged into a complementary first coupling socket in the hollow body, the sealing flange overlaying the entirety of said first torque coupling.

3. The pressure tank according to claim 2, wherein the at least one torque coupling of each connector includes a second torque coupling on an end face of the sealing flange, said second torque coupling being plugged into a complementary second coupling socket in the hollow body.

4. The pressure tank according to claim 1, wherein each connector includes elongated welding ribs integrally formed on the sealing flange and/or on the torque couplings, a profile of said welding ribs being either curved or angular, and another profile of said ribs being either straight throughout, undulating, dotted or dashed.

5. The pressure tank according to claim 4, wherein the welding ribs engage in weld notches, said weld notches having a shape that is complementary to that of said welding ribs, and said weld notches being positioned in a depression or in a coupling socket of the hollow body.

6. The pressure tank according to claim 4, wherein before welding or adhesively bonding, the welding ribs lie on corresponding welding ribs, said corresponding welding ribs being positioned in a depression or in a coupling socket of the hollow body.

7. The pressure tank according to claim 1, wherein each torque coupling and each corresponding coupling socket has a shape selected from the group consisting of rectangular, hexagonal, octagonal, nonagonal, decagonal, dodecagonal, polygonal, star shaped, a zigzag line, and an undulating line.

8. The pressure tank according to claim 2, wherein the first torque coupling includes a central core region and at least one strip extending radially from the core region, and the first coupling socket conforms to an outline of the first torque coupling.

9. The pressure tank according to claim 2, wherein the hollow body includes a depression configured to receive the sealing flange, said depression having a shape that conforms to an outline of said sealing flange, and said depression surrounds the first coupling socket.

10. The pressure tank according to claim 9, comprising a groove formed in the depression of the hollow body, the groove configured to receive a sealing member.

11. The pressure tank according to claim 1, comprising a layer on the hollow body, the layer being reinforced by at least one material selected from the group consisting of glass fibers, carbon fibers, Aramide fibers, Dyneema fibers, synthetic fibers, natural fibers, and plastic.

12. The pressure tank according to claim 11, wherein the resin is a thermally curable resin, or an ultraviolet light curable resin.

13. The pressure tank according to claim 1, wherein the connector is configured to receive a coupling piece.

14. The pressure tank according to claim 13, wherein the coupling piece is threaded piece or a bayonet.

15. The pressure tank according to claim 1, comprising a layer on the hollow body, the layer being reinforced by glass fibers and polyethylene, wherein the polyethylene flows around the glass fibers at elevated temperatures, and said layer including a resin.

16. The pressure tank according to claim 1, wherein the sealing flange is directly welded and/or adhesively bonded to the hollow body.

* * * * *